US011851142B2

(12) United States Patent
Haque et al.

(10) Patent No.: US 11,851,142 B2
(45) Date of Patent: Dec. 26, 2023

(54) FLOTATION DEVICE WITH RECEPTACLE

(71) Applicants: Zainah Yasmin Haque, Naperville, IL (US); Sarah Afshan Haque, Naperville, IL (US); Aeraj Ul Haque, Naperville, IL (US)

(72) Inventors: Zainah Yasmin Haque, Naperville, IL (US); Sarah Afshan Haque, Naperville, IL (US); Aeraj Ul Haque, Naperville, IL (US)

( * ) Notice: Subject to any disclaimer, the term of this patent is extended or adjusted under 35 U.S.C. 154(b) by 761 days.

(21) Appl. No.: 16/798,409

(22) Filed: Feb. 23, 2020

(65) Prior Publication Data

US 2021/0261223 A1 Aug. 26, 2021

(51) Int. Cl.
*B63B 34/565* (2020.01)
*B63B 32/40* (2020.01)

(52) U.S. Cl.
CPC ..... *B63B 34/565* (2020.02)

(58) Field of Classification Search
CPC ..... B63B 34/565; B63B 34/26; B63B 32/40; B63B 32/22; B63B 32/00; B63B 32/77
See application file for complete search history.

(56) References Cited

U.S. PATENT DOCUMENTS 4,290,156 A * 9/1981 Rawson ..... B63B 29/00 440/109
4,927,041 A * 5/1990 Hepburn ..... A01K 97/04 220/592.25
5,551,186 A * 9/1996 Harada ..... A01K 97/20 224/920
6,014,833 A * 1/2000 Benavidez ..... A01K 97/06 206/315.11
6,257,944 B1 * 7/2001 Herrod ..... F41B 9/004 441/130
6,318,590 B1 * 11/2001 McMurray-Stivers ..... B65D 83/0805 224/400
2002/0124591 A1 * 9/2002 Gano, III ..... B65D 77/0486 62/457.5
2003/0029878 A1 * 2/2003 Peitzmeier ..... B60N 3/106 220/737
2005/0247248 A1 * 11/2005 Caplan ..... B63B 32/40 114/66
2007/0148409 A1 * 6/2007 Rios ..... B32B 27/20 428/167
2008/0207068 A1 * 8/2008 Rockstad ..... B63B 32/51 441/66
2009/0039095 A1 * 2/2009 Ogura ..... B60N 3/106 220/737
2011/0114007 A1 * 5/2011 Flemons, III ..... B63B 34/20 114/347

(Continued)

FOREIGN PATENT DOCUMENTS

CA 2291739 C * 5/2008 ..... B60N 3/102

*Primary Examiner* — Christopher R Harmon

(57) ABSTRACT

A flotation device comprises a flotation device body structured to float on a water body. The flotation device body is substantially flat, has a first surface configured to contact, and float on the water body and a second surface opposite the first surface, the second surface configured to allow a user to stand or sit thereon. A receptacle is coupled to the first surface and extends away therefrom. An opening is defined through the flotation device body to allow the user to access the receptacle from the second surface.

9 Claims, 7 Drawing Sheets

(56) References Cited

U.S. PATENT DOCUMENTS

| | | | | |
|---|---|---|---|---|
| 2012/0040574 | A1* | 2/2012 | Grimes | B63B 32/70<br>441/74 |
| 2015/0335972 | A1* | 11/2015 | Fissell | A63B 67/002<br>273/407 |
| 2017/0291667 | A1* | 10/2017 | Campbell | B63B 32/77 |
| 2020/0317302 | A1* | 10/2020 | Moses | B63B 22/24 |
| 2020/0407027 | A1* | 12/2020 | Sheerer | B63B 32/73 |
| 2022/0041254 | A1* | 2/2022 | Rodriguez | B63B 32/70 |

* cited by examiner

FLOTATION DEVICE WITH RECEPTACLE

TECHNICAL FIELD

The present disclosure relates generally to flotation devices that can float on a water body and include a receptacle.

BACKGROUND

Flotation devices such as surfboards and paddleboards are a popular sport activity. Surfboarders or paddle boarders use flotation device to navigate water bodies, for example, ride flotation devices to float on rivers, lakes, oceans, or surf waves in the ocean. Generally, users of such flotation devices do not have any location to store beverages, edibles, or other belongings of the user on the flotation device. Users have to often return ashore to hydrate, enjoy a beverage, eat or retrieve their belongings, or carry them in a separate bag on the flotation device, which is inconvenient.

SUMMARY

Embodiments described herein relate generally to flotation devices such as paddleboards or surfboards that include an integrated receptacle. The receptacle may be configured to hold one or more beverage containers and/or serve as storage for storing beverages, edibles, or other belongings of a user.

In some embodiments, a flotation device comprises a flotation device body structured to float on a water body, the flotation device body being substantially flat and having a first surface configured to contact and float on the water body and a second surface opposite the first surface, the second surface configured to allow a user to stand or sit thereon; and a receptacle coupled to the first surface and extending away therefrom, an opening defined through the flotation device body to allow the user to access the receptacle from the second surface.

In some embodiments, a method comprises forming a flotation device body of a flotation device, the flotation device body being substantially flat and having a first surface configured to contact and float on a water body and a second surface opposite the first surface, the second surface configured to allow a user to stand or sit thereon, the flotation device body defining an opening therethrough; and forming a receptacle coupled to the first surface of the flotation device around the opening and extending away therefrom, an internal volume of the receptacle being accessible from the second surface of the flotation device through the opening.

It should be appreciated that all combinations of the foregoing concepts and additional concepts discussed in greater detail below (provided such concepts are not mutually inconsistent) are contemplated as being part of the subject matter disclosed herein. In particular, all combinations of claimed subject matter appearing at the end of this disclosure are contemplated as being part of the subject matter disclosed herein.

BRIEF DESCRIPTION OF THE DRAWINGS

The foregoing and other features of the present disclosure will become more fully apparent from the following description and appended claims, taken in conjunction with the accompanying drawings. Understanding that these drawings depict only several implementations in accordance with the disclosure and are therefore, not to be considered limiting of its scope, the disclosure will be described with additional specificity and detail through use of the accompanying drawings.

Figure 1:
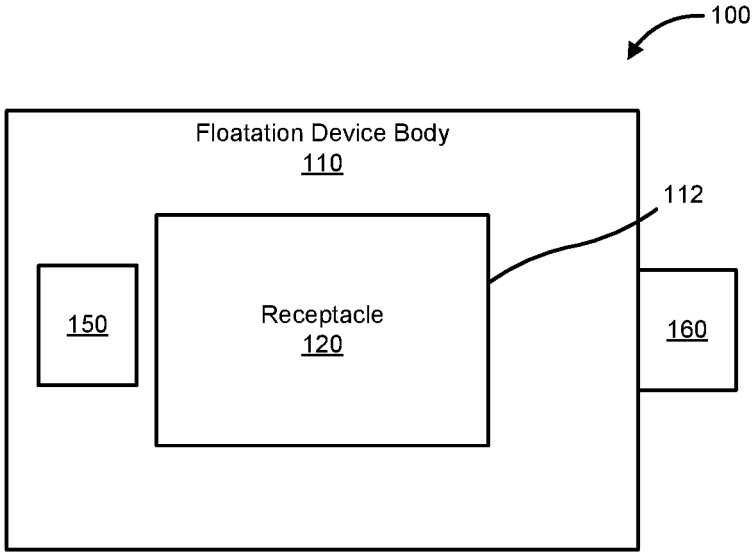
FIG. 1 is a schematic block diagram of a flotation device including a receptacle, according to an embodiment.

Reference is made to the accompanying drawings throughout the following detailed description. In the drawings, similar symbols typically identify similar components, unless context dictates otherwise. The illustrative implementations described in the detailed description, drawings, and claims are not meant to be limiting. Other implementations may be utilized, and other changes may be made, without departing from the spirit or scope of the subject matter presented here. It will be readily understood that the aspects of the present disclosure, as generally described herein, and illustrated in the figures, can be arranged, substituted, combined, and designed in a wide variety of different configurations, all of which are explicitly contemplated and made part of this disclosure.

DETAILED DESCRIPTION

Embodiments described herein relate generally to flotation devices such as paddleboards or surfboards that include an integrated receptacle. The receptacle may be configured to hold one or more beverage containers and/or serve as storage for storing beverages, edibles, or other belongings of a user.

Various embodiments of the flotation devices described herein may provide one or more benefits including, for example: (1) providing a receptacle integrated with a flotation device so as to allow a user to store beverages, edibles or other belongings of the user in the flotation device when floating over a water body; (2) providing various shaped receptacles to allow positioning of a single beverage container in the receptacle, a plurality of beverage containers, or larger objects in the receptacle; and (3) allowing fabrication of the receptacle with minor modifications to the fabrication process and minimal impact on aerodynamics of the flotation device.

FIG. 1 is a schematic block diagram of a flotation device 100 including a receptacle 120, according to an embodiment. The flotation device 100 may include a paddleboard, a surfboard or any other flotation device. The flotation device 100 includes a flotation device body 110 structured to float on a water body, for example, a river, lake, ocean, etc. The flotation device body 110 has a first surface configured to contact and float on the water body, and a second surface opposite the first surface. The second surface is configured to allow a user to stand or sit thereon. The flotation device body 110 may be formed from wood, fiberglass, carbon fiber, plastic, balsawood, polyurethane, or any other suitable material. The flotation device body 110 may also include foam encapsulated in a structural material (e.g., any of the materials described herein).

The flotation device body 110 has a front end or tip and rear end or tail. The flotation device body 110 may have any suitable shape, for example, oval, elliptical, or rectangular having a tip shape which is rounded or pointed, and a tail shape which is rounded square, rounded pin, swallow, square, pin, diamond, squash, star, rounded diamond, fish, bat, swallow tail with wings, fang, hip or any other tail shape which is used in paddle boards or surfboards. In some embodiments, one or more fins may be disposed on the first surface of the flotation device body 110 proximate to the tail of the flotation device body 110.

In some embodiments, the flotation device body 110 may be substantially flat. As utilized herein, the term "substantially" used with the term "flat" implies that the flotation device body 110 may not be perfectly flat but may have relative minor imperfections or undulations due to variations in the manufacturing process of the flotation device body. In other embodiments, the flotation device body 110 may be curved along a longitudinal axis thereof, for example, have a concave or convex shape.

The flotation device 100 also includes a receptacle 120 coupled to the first surface of the flotation device body 110 and extending away therefrom, such that the receptacle 120 is generally submerged in water when the flotation device 100 is floating on a water body. An opening 112 is defined through the flotation device body 110 and is configured to allow the user to access the receptacle 120 from the second surface that faces away from the water body.

In some embodiments, the receptacle 120 may be configured to hold a single beverage container. In some embodiments, a plurality of detents are defined on an inner surface of a sidewall of the receptacle. The plurality of detents may be configured to secure the beverage container within the receptacle 120. In other embodiments, a latch may be hingedly disposed on a sidewall of the receptacle 120. The latch may be configured to be moved between a first position in which the beverage container is insertable into the receptacle 120, and a second position in which the latch secures the beverage container within the receptacle 120. In some embodiments, the flotation device 100 may also include at least one arm disposed in the receptacle 120. A first end of the at least one arm is coupled (e.g., hingedly coupled) to the sidewall of the receptacle 120 and a second end of the at least one arm opposite the first end is configured to be rotated relative to the first end. In such embodiments, a biasing member may be coupled to the at least one arm and configured to bias the at least one arm towards the beverage container.

In some embodiments, the receptacle 120 has a depth such that at least a portion of the beverage container protrudes outwards from the second surface through the opening 112. In other embodiments, the receptacle 120 has a depth such that the beverage container is positioned substantially within the receptacle 120 and no portion of the beverage container protrudes outwards of the second surface.

In some embodiments, an insulating layer may be disposed in the receptacle 120, for example, to facilitate maintaining of a temperature of a beverage or edible (e.g., canned or packaged food) disposed in the receptacle 120. In some embodiments, at least one aperture is defined in the insulating layer, and each aperture is configured to hold a single beverage container.

In some embodiments, the flotation device 100 also comprises a receptacle lid positioned on the second surface of the flotation device body 110 and coupled to a rim of the receptacle 120 or the opening 112. The receptacle lid is movable between a first position in which the receptacle 120 is closed, and a second position in which the receptacle 120 is accessible by a user. In some embodiments, a receptacle lid latch may be coupled to the receptacle lid, and configured to be engaged by a user to move the receptacle lid between the first position and the second position, i.e., open or close the receptacle 120.

The receptacle 120 may have any suitable shape. In some embodiments, the receptacle 120 may have a shape corresponding to a shape of the flotation device body 110. For example, the receptacle 120 may have an oval shape, an elliptical shape, or a rectangular shape with a front end that is located proximate to the tip of the flotation device body 110 being rounded, and a rear end that is located proximate to the tail of the flotation device body 110 being rounded or pointed. In some embodiments, a sidewall of the receptacle 120 located proximate to a front end (i.e., tip) of the flotation device body 110 may define a wedge shape.

In some embodiments, the flotation device 100 may also include a propeller 160 disposed on the first surface of the flotation device body 110 and configured to propel the flotation device 100 on water. For example, the propeller 160 may be powered by a motor (e.g., a gas, oil, or electric powered motor). The propeller 160 is positioned proximate to the tail of the flotation device body 110. Furthermore, a steering 150 may be disposed on the second surface of the flotation device body 110 and configured to be engaged by a user to control a direction of motion of the flotation device 100 on the water body. For example, the steering 150 may be operatively coupled to the propeller 160 or a fin disposed on the first surface of the flotation device body 110 and configured to adjust an angle of the propeller 160 and/or the fin to cause the flotation device to turn in a particular direction. In some embodiments, an accelerator pedal may be included in the steering 150 to allow the user to adjust a speed of the propeller 160.

Figure 2:
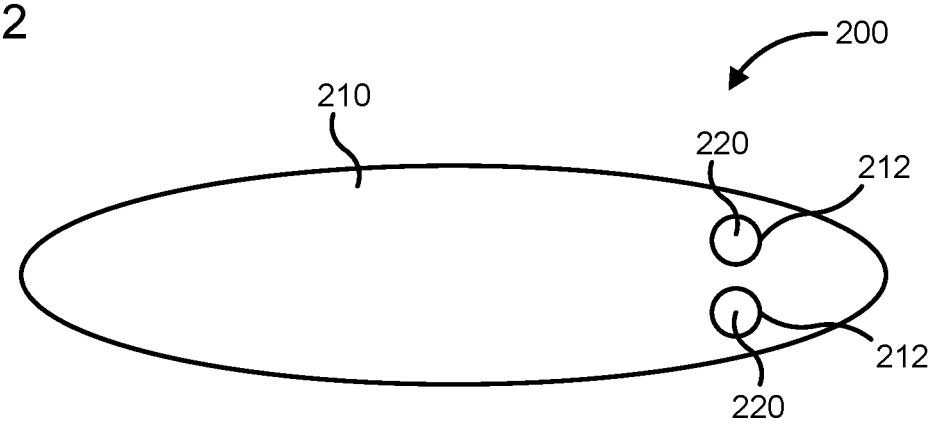
FIG. 2 is a top plan view and FIG. 3 is a side elevation view of a flotation device, according to an embodiment.
Figure 3:
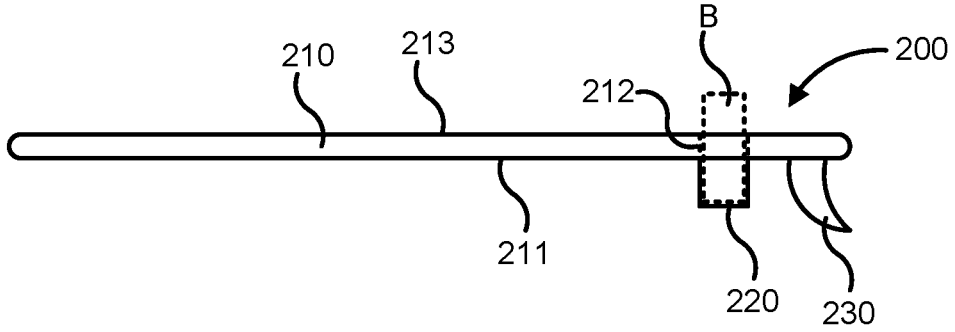

FIG. 2 is a top plan view and FIG. 3 is a side elevation view of a flotation device 200, according to an embodiment. The flotation device 200 may include a paddleboard or a surfboard. The flotation device 200 includes a flotation device body 210 structured to float on water. In various embodiments, the flotation device body 210 may be formed for one or more materials including, but not limited to wood, foam, carbon fiber, fiberglass, polyvinyl chloride (PVC), etc. In some embodiments, the flotation device body 210 may have a generally oval or ellipsoid shape with rounded axial ends. In other embodiments, one or both axial ends of the flotation device body 210 may be tapered to a point or chamfered.

The flotation device body 210 is structured to float on a water body (e.g., on a lake, river, sea, etc.). The flotation device body 210 has a first surface 211 configured to contact and float on the water body, and a second surface 213 opposite the first surface 211, which is configured to allow a user to stand or sit thereon, therefore allowing the user to float when standing or seated on the flotation device 200.

One or more fins 230 may project from the first surface 211 away from the flotation device body 210. The one or more fins 230 project below the surface of water and facilitate movement of the flotation device 200 on water.

At least once receptacle 220 is coupled to the first surface 211 and extends away therefrom so that the receptacle 220 protrudes below the surface of water when the flotation device 200 is floating on water. At least one opening 212 is defined through the flotation device body 210 at locations where at least once receptacle 220 is located so as to allow the user to access a corresponding receptacle 220 from the second surface 213. In various embodiments, the receptacle 220 is sized and shaped to hold a beverage container B, for example, a soda can, a beer can, a soda bottle, a water bottle, or any other suitable beverage container. In various embodiments, each receptacle 220 may be configured to hold a single beverage container B. For example, each receptacle 220 may be shaped as cup holder, mug holder, or can holder. In some embodiments, the receptacle 220 may be separately formed and then coupled to the first surface 211 (e.g., via an adhesive, screws, nuts, bolts, etc.). In other embodiments, the receptacle 220 may be monolithically formed with the flotation device body 210 (e.g., molded therewith).

Figure 4:
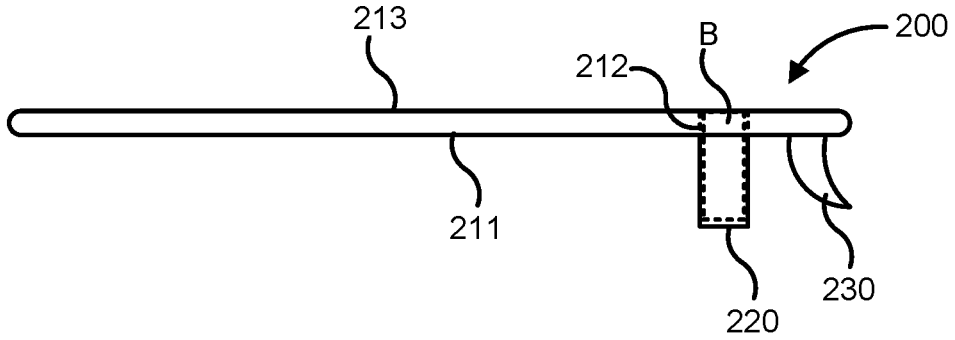
FIG. 4 is a side elevation view of a flotation device, according to another embodiment.
Figure 5:
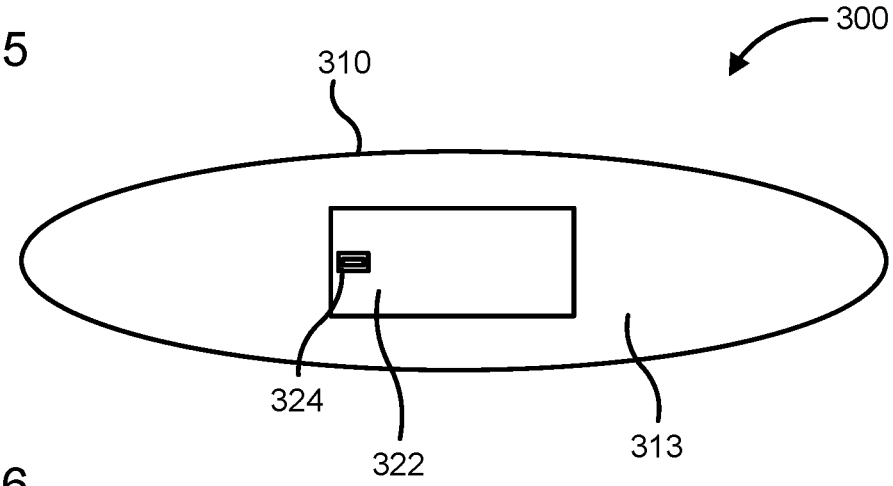
FIG. 5 is a top plan view.

In some embodiments as shown in FIGS. 2-3, the receptacle 220 may have a depth such that when the beverage container B is positioned in the receptacle 220, a portion of the beverage container B protrudes outwards from the opening 212 outwards from the second surface 213 and an axial end of the beverage container B is located above the second surface 213. In other embodiments as shown in FIG. 4, the receptacle 220 may have a depth such that the beverage container B is positioned substantially within the receptacle 220 and no portion of the beverage container B protrudes outwards of the second surface 213. For example, an axial end of the beverage container B that is proximate to the second surface 213 may be either flush with the second surface 213 or located below the second surface 213.

Figure 12:
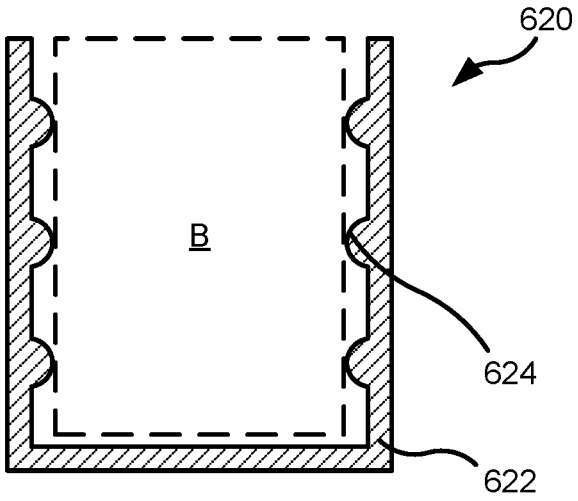
FIG. 12 is a side cross-section view of a receptacle for a flotation device, according to an embodiment.

In some embodiments, features may be provided in the receptacle 220 to secure the beverage container B within the receptacle 220. For example, FIG. 12 is a side cross-section view of a receptacle 620 for a flotation device (e.g., the flotation device 100, 200), according to an embodiment. The receptacle 620 includes a sidewall 622, for example, a circular sidewall) such that the receptacle 620 has a cylindrical profile. A plurality of detents 624 are defined on an inner surface of the sidewall 622 of the receptacle 620 such that the plurality of detents 624 protrude into the internal volume defined by the receptacle 620. The plurality of detents 624 are configured to secure the beverage container B within the receptacle 620 by applying a compressive force on the beverage container B when the beverage container B is disposed in the receptacle 620. The plurality of detents 624 may be monolithically formed with the receptacle 620. In some embodiments, the plurality of detents 624 may be formed from a high friction material, for example, rubber, rubberized carbon, polymers, etc. to cause the plurality of detents 624 to secure the beverage container B in the receptacle 620 under the force of friction.

Figure 13:
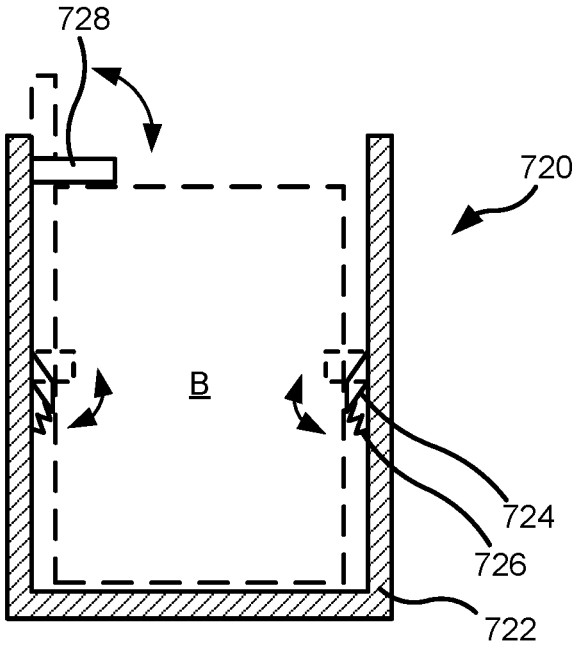
FIG. 13 is a side cross-section view of a receptacle for a flotation device, according to yet another embodiment.

FIG. 13 is a side cross-section view of a receptacle 720 for a flotation device (e.g., the flotation device 100, 200), according to another embodiment. The receptacle 720 includes a securement latch 728 hingedly disposed on a sidewall 722 of the receptacle 720 proximate to a rim of the receptacle 720. For example, the securement latch 728 may be coupled to the sidewall 722 via a hinge. The securement latch 728 is configured to be moved between a first position in which the securement latch 728 is articulated away from the rim of the receptacle 720 such that the beverage container B is insertable into the receptacle 720, and a second positioned in which the securement latch 728 articulates towards the rim of the receptacle 720 to secure the beverage container B within the receptacle 720. In some embodiments, the securement latch 728 may be selectively locked in the second position (e.g., via a snap-fit mechanism, a friction fit mechanism, etc.) or biased towards the second position via a biasing member (not shown), e.g., a spring.

In some embodiments, at least one arm 724 may also be included in the receptacle 720. For example, as shown in FIG. 13 a pair of arms 724 are disposed on the sidewall 722 of the receptacle 720 opposite to each other within an internal volume defined by the receptacle 720. A first end of each arm 724 is coupled to the sidewall 722, and a second end of each arm 724 opposite the first is configured to be rotated or articulated relative to the first end. For example, the first end may be hingedly coupled to the sidewall 722. As the beverage container B is inserted into the receptacle 720, the beverage container B urges each arm 724 to rotated about its first end such that the second end of each arm is located proximate to the sidewall 722. A biasing member 726 is coupled to each arm 724 and configured to bias the corresponding arm 724 towards the beverage container B. The biasing force may cause the arms 724 to secure the beverage container B within the receptacle 720, as well as urge the beverage container B out of the receptacle 720 when the securement latch 728 is moved into its first position.

Referring now to FIGS. 5-8, a flotation device 300 (e.g., a surfboard or paddleboard) is shown, according to another embodiment. The flotation device 300 includes a flotation device body 310, which may be substantially similar to the flotation device body 210. The flotation device body 310 is structured to float on a water body (e.g., on a lake, river, sea, etc.) and has a first surface 311 configured to contact and float on the water body, and a second surface 313 opposite the first surface 311, which is configured to allow a user to stand or sit thereon, therefore allowing the user to float when standing or seated on the flotation device 300. One or more fins 330 may project from the first surface 311 away from the flotation device body 310. The one or more fins 330 project below the surface of water and facilitate movement of the flotation device 300 on water.

A receptacle 320 is coupled to the first surface 311 and extends away therefrom so that the receptacle 320 protrudes below the surface of water when the flotation device 300 is floating on water. An opening is defined through the flotation device body 310 at a location where the receptacle 320 is coupled to the flotation device body 310 so as to allow the user to access the receptacle 320 from the second surface 313. A receptacle lid 322 is positioned on the second surface 313 and coupled to a rim of the receptacle 320. For example, the receptacle lid 322 may be hingedly coupled to the rim of the receptacle 320 and configured to be moved between a first position in which the receptacle 320 is closed and a second position in which the receptacle 320 is accessible by a user. A latch 324 may be operatively coupled to the receptacle lid 322 and configured to secure the receptacle lid 322 to the flotation device body 310. The user may engage the latch 324 to release the receptacle lid 322 from the flotation device body 310 as well serve as a handle for moving the receptacle lid 322 into the second position.

Figure 6:
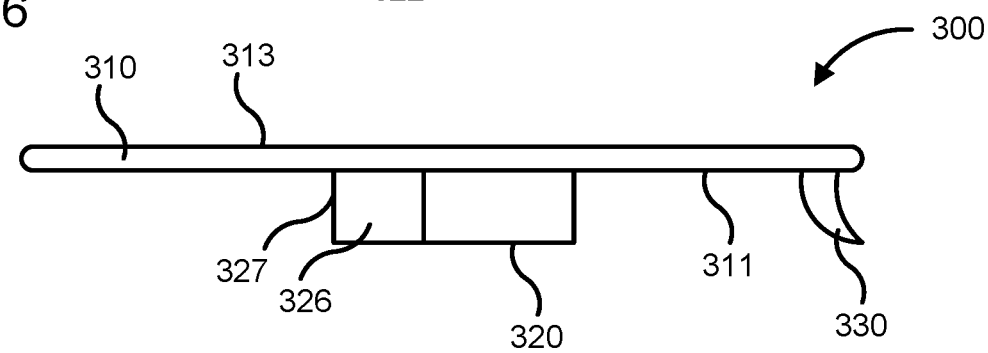
FIG. 6 is a side elevation view.
Figure 7:
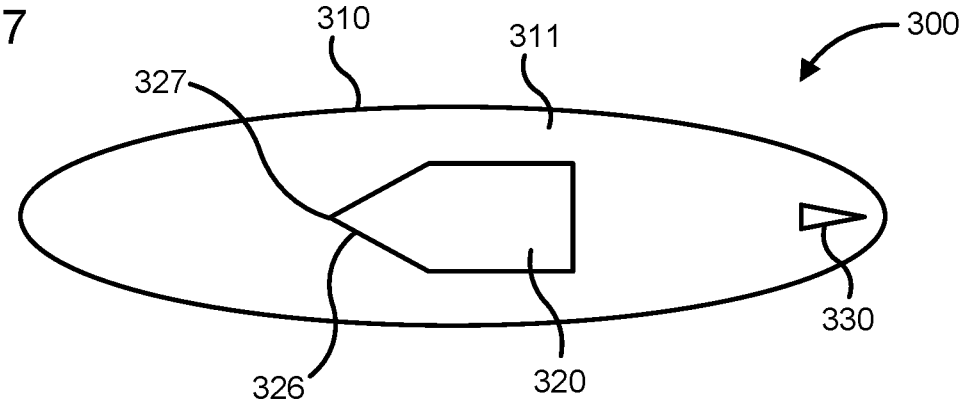
FIG. 7 is a bottom plan view.
Figure 8:
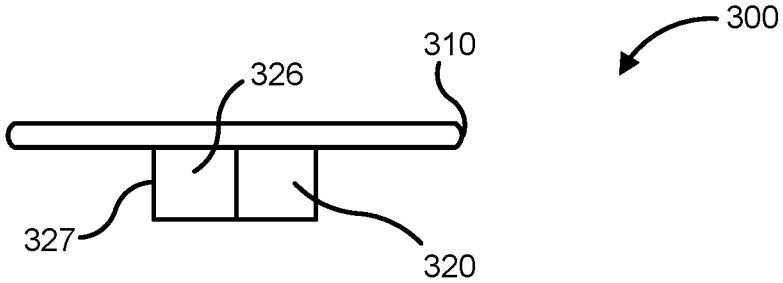
FIG. 8 is a front elevation view of a flotation device, according to yet another embodiment.

Different from receptacle 220, the receptacle 320 has a much larger size allowing the user to stow beverage containers or other items belonging to the user within the receptacle 320. In some embodiments, the receptacle 320 may have a shape configured to reduce drag exerted by the water on the receptacle 320, and thereby the flotation device 300. For example, as shown in FIGS. 6-8, the receptacle 320 has a sidewall 326 that is located proximate to a front end of the flotation device body 310 and defines a wedge shape so as to have a sharp tip 327 that cuts through the water as the flotation device 300 moves through the water, so as to reduce viscous drag on the receptacle 320.

Figure 9:
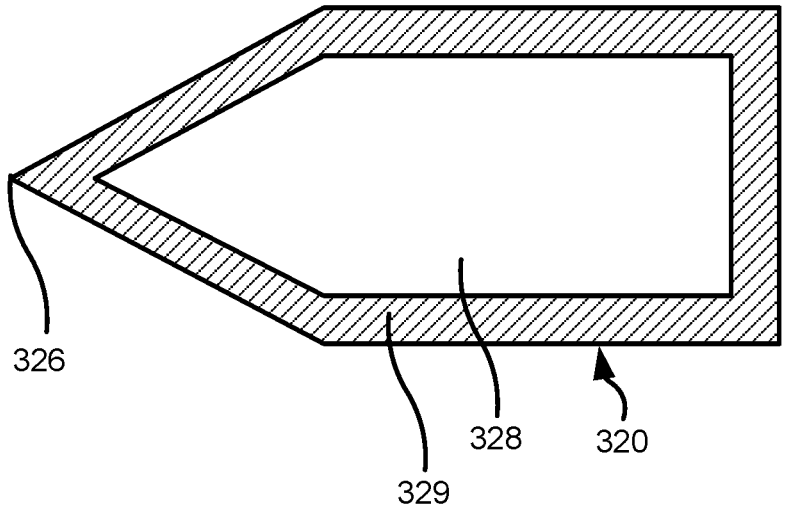
FIG. 9 is a top view of receptacle that may be included in a flotation device, according to an embodiment.

FIG. 9 shows is a top view of the receptacle 320 removed from a flotation device body 310, according to a particular embodiment. An insulating layer 329 is disposed within an internal volume 328 defined by the receptacle 320, for example, along an inner surface of the sidewall of the receptacle. The insulating layer 329 may include, for example, a foam layer, a rubber layer, a polystyrene layer, a fiber glass layer or any other suitable insulating layer 329, and is configured to maintain objects disposed within the receptacle 320 (e.g., a beverage) at an initial temperature of the object at which the object was initially disposed within the receptacle 320, for at least a period of time (e.g., 1 hour to 4 hours, inclusive).

Figure 10:
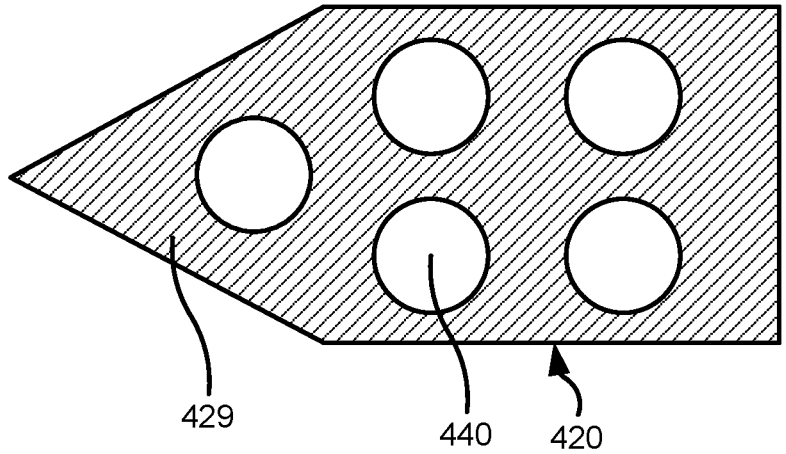
FIG. 10 is a top view of a receptacle that may be included in a flotation device, according to another embodiment.

In other embodiments, an insulating layer may be disposed through a significant portion of the volume of a receptacle of a flotation device and define apertures or slots, each shaped and sized to receive and secure a single beverage container. For example, FIG. 10 is a top view of a receptacle 420 that may be included in the flotation device 100, 300, or any other flotation device described herein. The receptacle 420 is similar in shape and structure to the receptacle 320. However, different from the receptacle 320, an insulating layer 429 is disposed in the receptacle 420, which is shaped as a block having the shape and size of the receptacle 420, such that insulating layer 429 occupies a significant portion of an internal volume of the receptacle 420. The insulating layer 429 may be formed from any of the materials as described with respect to the insulating layer 329. A plurality of apertures 440 are defined in the insulating layer 429. Each of the plurality of apertures 440 is configured to hold a single beverage container. While shown in FIG. 10 as having the same cross-sectional width (e.g., diameter) in other embodiments, at least a portion of the apertures 440 may have a larger or smaller cross-sectional width (e.g., diameter) to allow different sized beverage containers to be disposed in and secured (e.g., via friction) within a corresponding aperture 440.

Figure 11:
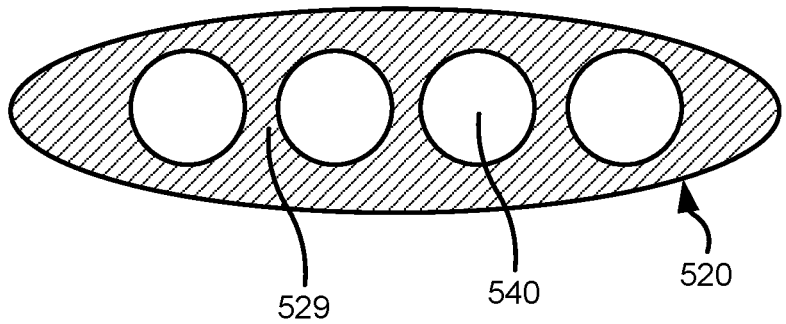
FIG. 11 is a top view a receptacle that may be included in a flotation device, according to yet another embodiment.

While FIGS. 5-10 show the receptacle 320, 420 as having a wedge shape, in other embodiments, a receptacle included in a flotation device may have any other suitable shape. For example, FIG. 11 is a top view of a receptacle 520 that may be included in a flotation device (e.g., the flotation device 100, 200, 300). The receptacle 520 has an oval or elliptical shape that may correspond to a shape of a flotation device body of a flotation device to which the receptacle 520 is coupled. An insulating layer 529 is disposed in the receptacle 520 and may include a plurality of apertures 540, each of which is configured to receive a single beverage container.

Figure 14:
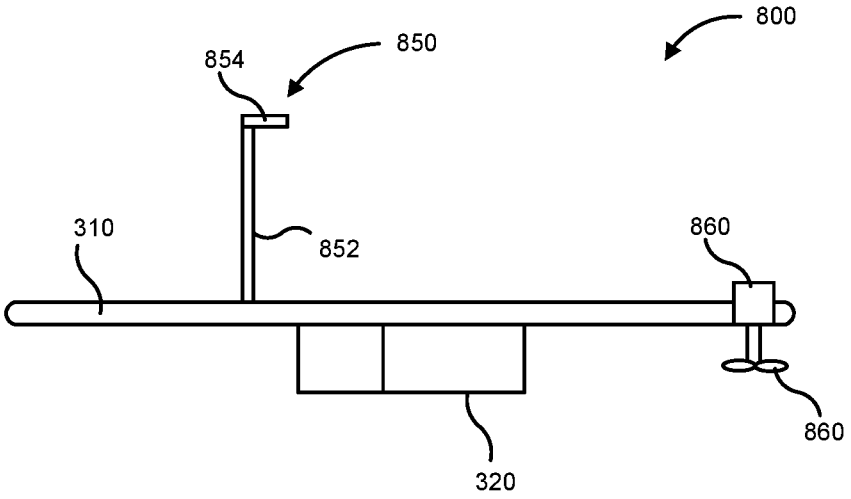
FIG. 14 is a side view of a flotation device including a receptacle, according to an embodiment.

In some embodiments, a flotation device may include a motor and steering to allow powered control of the flotation device. For example, FIG. 14 is a side view of a flotation device 800, according to an embodiment. The flotation device 800 includes the flotation device body 310 including the receptacle 320, as previously described herein. A motor 860 (e.g., a gasoline powered motor, a diesel powered motor, an alcohol powered motor, or an electric motor) is coupled to a rear or trailing end of the flotation device body 310. A propeller 862 is coupled to and driven by the motor 860, and configured to propel the flotation device 100 in water. A steering assembly 850 is disposed on the flotation device body 310, for example, proximate to a front or leading end of the flotation device body 310. The steering assembly 850 may include a steering rod 852 having a steering 854 coupled thereto. The steering rod 852 may be operatively coupled to the propeller 862 via a cable, rod or any other suitable coupling mechanism. The steering 854 can be engaged by a user to cause the steering rod 852 to turn in desired direction, which in turn causes the propeller 862 to turn in the same direction and steer the flotation device 100 in the said direction. In some embodiments, the motor 860 and/or steering assembly 850 or at least a portion of the steering assembly 850 (e.g., the steering 854) may be removably coupled to the flotation device body 310. In some embodiments, the steering rod 852 may be configured to rotate about an end of the steering rod 852 that is located proximate to the flotation device body 310. For example, the steering rod 852 may be rotated about its end to position the steering rod flat against the flotation device body 310 when stowing the flotation device 800 to provide space saving.

Figure 15:
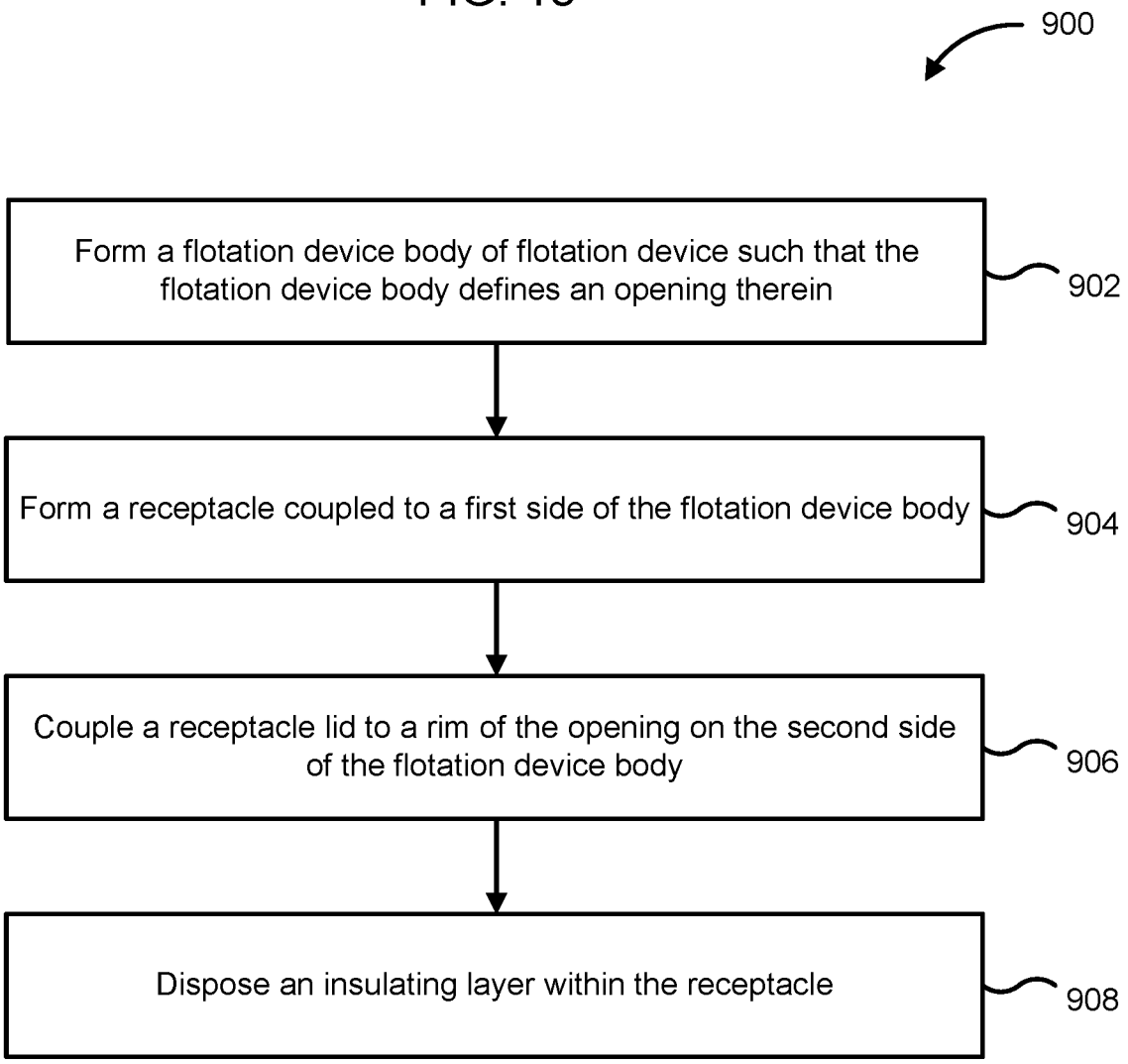
FIG. 15 is a schematic flow chart of a method for forming a flotation device including a receptacle, according to an embodiment.

FIG. 15 is a schematic flow diagram of a method 900 for forming flotation device including a receptacle, according to an embodiment. The method 900 includes forming a flotation device body (e.g., the flotation device body 110, 210, 310) of a flotation device (e.g., the flotation device 100, 200, 300) such that the flotation device body has a first surface configured to contact and float on a water body and a second surface opposite the first surface, which is configured to allow a user to stand or sit thereon, at 902. The flotation device body defines an opening therethrough, as previously described herein.

At 904, a receptacle (e.g., the receptacle, 120, 220, 320, 420, 520, 620, 720) is formed. The receptacle is coupled to the first surface of the flotation device body around the opening and extends away therefrom. An internal volume of the receptacle being accessible from the first surface of the flotation device through the opening. In some embodiments, the receptacle is monolithically formed with the flotation device body such that operations 902 and 904 occur in a single step. In some embodiments, the receptacle is configured to hold a single beverage container. In some embodiments the receptacle has a depth such that at least a portion of the beverage container protrudes outwards of the second surface through the opening. In other embodiments, the receptacle has a depth such that the beverage container is positioned substantially within the receptacle and no portion of the beverage container protrudes outwards of the second surface.

In some embodiments, a receptacle lid (e.g., the receptacle lid 322) is coupled to a rim of the receptacle on the second surface of the flotation device body, at 906. The receptacle lid is movable between a first position in which the receptacle is closed, and a second position in which the receptacle is accessible by a user, as previously described herein.

In some embodiments, the method 900 also includes disposing an insulating layer within the receptacle, at 908. In some embodiments, the insulating layer may include the insulating layer 329 disposed along inner sidewalls of the receptacle 320. In other embodiments, the insulating layer may include insulating layer 429 or 529. In such embodiments, at least one aperture (e.g., the aperture 440, 540) in the insulating layer, each of the at least one aperture configured to hold a single beverage container.

As used herein, the singular forms "a", "an" and "the" include plural referents unless the context clearly dictates otherwise. Thus, for example, the term "a member" is intended to mean a single member or a combination of members, "a material" is intended to mean one or more materials, or a combination thereof.

The terms "coupled," and the like as used herein mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

It should be noted that the term "example" as used herein to describe various embodiments is intended to indicate that such embodiments are possible examples, representations, and/or illustrations of possible embodiments (and such term is not intended to connote that such embodiments are necessarily extraordinary or superlative examples).

In the above description, certain terms may be used such as "up," "down," "upper," "lower," "top," "bottom," "upper," "lower," "left," "right," and the like. These terms are used, where applicable, to provide some clarity of description when dealing with relative relationships. But, these terms are not intended to imply absolute relationships, positions, and/or orientations. For example, with respect to an object, an "upper" surface can become a "lower" surface simply by turning the object over. Nevertheless, it is still the same object. Further, the terms "including," "comprising," "having," and variations thereof mean "including but not limited to" unless expressly specified otherwise. An enumerated listing of items does not imply that any or all of the items are mutually exclusive and/or mutually inclusive, unless expressly specified otherwise.

It is important to note that the construction and arrangement of the various exemplary embodiments are illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. Additionally, it should be understood that features from one embodiment disclosed herein may be combined with features of other embodiments disclosed herein as one of ordinary skill in the art would understand. Other substitutions, modifications, changes and omissions may also be made in the design, operating conditions and arrangement of the various exemplary embodiments without departing from the scope of the present invention.

While this specification contains many specific implementation details, these should not be construed as limitations on the scope of any inventions or of what may be claimed, but rather as descriptions of features specific to particular implementations of particular inventions. Certain features described in this specification in the context of separate implementations can also be implemented in combination in a single implementation. Conversely, various features described in the context of a single implementation can also be implemented in multiple implementations separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

What is claimed is:

1. A flotation device, comprising:

a flotation device body including a surfboard or a paddleboard structured to float on a water body, the flotation device body having a first surface configured to contact and float on the water body and a second surface opposite the first surface, the second surface configured to allow a user to stand or sit thereon;

a receptacle coupled to the first surface and extending away from the first surface and the second surface such that at least a portion of the receptacle is submerged in the water and an outer surface of the receptacle is in contact with water when the first surface contacts the water body, an opening defined through the flotation device body to allow the user to access the receptacle from the second surface, the receptacle configured to hold a single beverage container that has a cross-sectional width that is equal to or less than a cross-sectional width of the receptacle, and a height that is equal to or less than a height of the receptacle; and a latch hingedly disposed on a sidewall of the receptacle at an end of the receptacle located proximate to a rim of the receptacle, the latch configured to be moved between a first position in which the latch is articulated away from the receptacle such that the beverage container is insertable into the receptacle, and a second position in which the latch is articulated towards the receptacle so as to contact or be proximate to an upper surface of the beverage container to secure the beverage container within the receptacle.

2. The flotation device of claim 1, wherein a plurality of detents are defined on an inner surface of a sidewall of the receptacle, the plurality of detents configured to secure the beverage container within the receptacle.

3. The flotation device of claim 1, further comprising:

at least one arm, a first end of the at least one arm coupled to the sidewall and a second end of the at least one arm off opposite the first end configured to be rotated relative to the first end; and a biasing member coupled to the at least one arm and configured to bias the arm towards the beverage container.

4. The flotation device of claim 1, further comprising:

a propeller disposed on the first surface of the flotation device body and configured to propel the flotation device on the water body; and a steering assembly disposed on the second surface of the floating device proximate to a front end of the flotation device body, the steering assembly comprising:

the steering rod coupled to the second surface and extending upward from the second surface in an operating configuration of the steering assembly, the steering rod operatively coupled to the propeller, and a steering coupled to the steering rod and configured to be engaged by a user to cause the steering rod to turn in a desired direction to cause the propeller to turn in the desired direction.

5. The flotation device of claim 4, wherein at least a portion of the steering assembly is removably coupled to the flotation device body.

6. The flotation device of claim 4, wherein the steering rod is configured to be rotated to about an end thereof located proximate to the flotation device body to position the steering rod flat against the flotation device body for stowing.

7. The flotation device of claim 4, wherein the steering is removably coupled to the steering rod.

8. The flotation device of claim 1, wherein the latch is configured to be selectively locked in the second position.

9. The flotation device of claim 1, wherein a biasing member is coupled to the latch, the biasing member configured to bias the latch towards the second position.

* * * * *